US011851149B2

(12) United States Patent
Shoham et al.

(10) Patent No.: US 11,851,149 B2
(45) Date of Patent: Dec. 26, 2023

(54) EMERGENCY FLOTATION DEVICE USING COMPRESSED GAS

(71) Applicant: Sea Ark Technologies Ltd., Raanana (IL)

(72) Inventors: Oriya Shoham, Yakir (IL); Moshe Shoham, Hoshaya (IL); Matityahu Azriel, Mazkeret Batya (IL)

(73) Assignee: SEA ARK TECHNOLOGIES LTD., Raanana (IL)

( * ) Notice: Subject to any disclaimer, the term of this patent is extended or adjusted under 35 U.S.C. 154(b) by 106 days.

(21) Appl. No.: 17/601,933

(22) PCT Filed: Apr. 7, 2020

(86) PCT No.: PCT/IL2020/050429
§ 371 (c)(1),
(2) Date: Oct. 7, 2021

(87) PCT Pub. No.: WO2020/208636
PCT Pub. Date: Oct. 15, 2020

(65) Prior Publication Data

US 2022/0144394 A1 May 12, 2022

Related U.S. Application Data

(60) Provisional application No. 62/830,465, filed on Apr. 7, 2019.

(51) Int. Cl.
*B63C 9/105* (2006.01)
*B63C 9/15* (2006.01)
(Continued)

(52) U.S. Cl.
CPC ..... *B63C 9/105* (2013.01); *B63C 9/15* (2013.01); *B63C 9/18* (2013.01); *B63C 2009/131* (2013.01); *B63C 2009/133* (2013.01)

(58) Field of Classification Search
CPC .. B63C 9/105; B63C 9/15; B63C 9/18; B63C 2009/131; B63C 2009/133;
(Continued)

(56) References Cited

U.S. PATENT DOCUMENTS 547,808 A 10/1895 Von Der Ropp
572,109 A 12/1896 Gordon
(Continued)

FOREIGN PATENT DOCUMENTS

CH 569611 A5 11/1975
CN 1282697 2/2001
(Continued)

OTHER PUBLICATIONS

AGC Chemical, Amolea 1224yd Brochure, retrieved from https://www.agc-chemicals.com/file.jsp?id=32118 Jul. 27, 2023 (Year: 2019).*
(Continued)

*Primary Examiner* — Andrew Polay
(74) *Attorney, Agent, or Firm* — Daniel Feigelson

(57) ABSTRACT

A flotation device for providing emergency flotation for a person swimming or passing through a body of water, comprising a container filled with a charge of a gaseous material under a pressure such that it is in its liquid phase at normal environmental temperatures. The container is connected to a flexible flotation chamber through a passage which remains normally closed until actuated by the user. When the device is actuated by opening the passage, the charge expands into the flotation chamber, thereby inflating it, and providing support to the user in the water. The gaseous material has thermodynamic properties such that it remains in its liquid phase right up to the maximum temperatures to which the device is expected to be exposed to. Consequently, its volume, and hence the internal pressure within the gas container, does not increase significantly,
(Continued)

thereby enabling the container to be of lightweight construction.

12 Claims, 2 Drawing Sheets

(51) Int. Cl.
*B63C 9/18* (2006.01)
*B63C 9/13* (2006.01)

(58) Field of Classification Search
CPC .... B63C 2009/0023; B63C 2009/0029; B63C 2009/0035; B63C 2009/0041; B63C 2009/0047; B63C 2009/0052; B63C 2009/0058; B63C 2009/0064; B63C 2009/007; B63C 9/19
See application file for complete search history.

(56) References Cited

U.S. PATENT DOCUMENTS

| | | | | |
|---|---|---|---|---|
| 1,117,639 | A | 11/1914 | Cooey | |
| 1,367,225 | A | 2/1921 | Barker | |
| 2,028,651 | A | 1/1936 | Dagnall et al. | |
| 2,518,750 | A | 7/1949 | Burkhardt | |
| 2,684,784 | A | 8/1951 | Fox | |
| 2,627,998 | A | 2/1953 | Musser et al. | |
| 2,904,217 | A | 8/1955 | Gurney | |
| 3,144,667 | A * | 8/1964 | Dobbs | B63C 9/155 441/93 |
| 3,693,202 | A | 9/1972 | Ohtani | |
| 3,925,838 | A | 12/1975 | Kennedy | |
| 4,968,277 | A * | 11/1990 | Parish | B63C 9/18 441/10 |
| 2016/0129977 | A1 * | 5/2016 | Huang | B63C 9/155 441/96 |
| 2020/0407031 | A1 | 12/2020 | Azriel et al. | |

FOREIGN PATENT DOCUMENTS

| | | | |
|---|---|---|---|
| CN | 2466045 | | 12/2001 |
| CN | 107719605 | A * | 2/2018 |
| DE | 202012007732 | U1 | 3/2013 |
| GB | 2130972 | B | 9/1985 |
| WO | 83/04234 | | 12/1983 |
| WO | 2004/048193 | A1 | 6/2004 |
| WO | 2005/095203 | A1 | 10/2005 |
| WO | 2014077728 | | 5/2014 |

OTHER PUBLICATIONS

Supplementary European Search Report in EP Patent Application No. 20787462.9, dated Dec. 15, 2022, 6 pages.
"The Environmental Alternative to Traditional Refrigerants" Honeywell Belgium N.V, Dec. 2015.
R-12 thermodynamic data, Engineering ToolBox, (Dec. 2005). "Dichlorodifluoromethane—Properties". Available at https://www.engineeringtoolbox.com/dichlorodifluoromethane-d_1001.html, accessed Sep. 4, 2022.
R-134 thermodynamic data, Engineering Tool, (Dec. 2010). "Refrigerant R134a—Properties". Available at https://www.engineeringtoolbox.com/r134a-properties-d_1682.html, accessed Sep. 4, 2022.
International Search Report and Written Opinion of PCT/II2020/050429, dated Jul. 9, 2020.

* cited by examiner

Pressure and temperature

| Temperature °C | Pressure (absolute) kPa |
|---|---|
| -40 | 37 |
| -35 | 48 |
| -30 | 61 |
| -25 | 77 |
| -20 | 97 |
| -15 | 120 |
| -10 | 147 |
| -5 | 179 |
| 0 | 216 |
| 5 | 259 |
| 10 | 308 |
| 15 | 364 |
| 20 | 427 |
| 25 | 499 |
| 30 | 578 |
| 35 | 668 |
| 40 | 767 |
| 45 | 876 |
| 50 | 997 |
| 55 | 1131 |
| 60 | 1277 |
| 65 | 1437 |
| 70 | 1611 |

EMERGENCY FLOTATION DEVICE USING COMPRESSED GAS

FIELD OF THE DISCLOSURE

The present disclosure relates to the field of emergency flotation devices, for use in prevention of drowning accidents, especially devices using a compressed gas to inflate the flotation device.

BACKGROUND

Drowning is a major cause of death worldwide, claiming the lives of more than 300,000 people every year. Many of the drowning events occur in natural waters such as the sea and lakes in the absence of a supervising life guard, and many would have been preventable with use of a personal flotation device.

Many previous references describe bracelets, armbands, and other inflatable devices designed for emergency use. Some prior references describe devices that use chemical reactions that, when actuated, produce gas to inflate the device. In PCT International Application No. PCT/IL2018/051314, for "Emergency Flotation Device with Chemical Reaction Chamber", having common inventors with the present application, there are described a number of novel devices using this principle, in addition to some earlier devices.

In addition, there have existed, since the late $19^{th}$. century, inflation devices of a second type, based on pressurized gases released on activation into an inflatable flotation chamber. A number of such devices include US 547,808 to A. von der Ropp, for "Life Preserver", US 572,109 to T. Gordon, for "Life Preserver", U.S. Pat. No. 1,117,639 to H. W. Cooey for "Portable Life Buoy", U.S. Pat. No. 1,367,225 to W. H. Barker, for "Life Belt", U.S. Pat. No. 2,028,651 to R. F. Dagnall et al, for "Release Mechanism for Pressure Fluid Containers, U.S. Pat. No. 2,518,750 to E. H. Burkhardt for "Lifesaving Device", U.S. Pat. No. 2,627,998 to C. W. Musser et al, for "Inflator for Pneumatic Lifesaving Devices", U.S. Pat. No. 2,684,784 to R. G. Fox, for "Inflator for Pneumatic Life Preserving Apparatus", U.S. Pat. No. 2,904,217 to J. T. Gurney for "Automatic Life Preserver", U.S. Pat. No. 3,693,202 to T Y. Ohtani, for Sea Rescue Ball Unit", CH 569611 for "Automatic Rescue Apparatus", WO83/04234 to J. Bissig for "Rescue Apparatus", WO 2014/077728 to P. P. Mukhortov for "Life-saving wristband", DE 202012007732 to G. Schmelzer for "Rescue bracelet or water airbag for bathers or swimmers, such as children, young people of all ages, adults, seniors".

In a life saving device, the efficiency, simplicity, consistency of performance, and fail-safe abilities of the device are critical, since a lack of gas produced, or a malfunction, may cost a person his life. Additionally, all such previously described devices have the disadvantage that a cartridge, cylinder or vessel of compressed gas is required, and such a cartridge, cylinder or vessel needs to be sturdy enough to withstand the pressure of the gas, and hence is expected to be of additional weight and volume, thereby conflicting with the intended purpose of the device, which should be lightweight, of minimal size, and unobtrusive, in the sense that it can be worn without impeding the swimming movements of the person wearing it. Furthermore, the device should be storable for long periods, usable under all environmental conditions expected to be encountered, and inexpensive to produce since it should be capable of being constructed as a disposable product. The device should not interfere with the user's swimming ability. The undeployed target size of such a device is that it should be in a package having a total volume of the order of up to 50 ml, and a maximum weight of the order of 100 gm, though these target figures may need to be exceeded somewhat according to construction methods of the device, and the average size of swimmer to be accommodated. In order to support an adult swimmer, the inflated volume of the flotation bag should be at least 5 liters, while the volume of the compressed gas in the cylinder should ideally be of the order of 20 ml., or slightly more, in order to maintain the above-mentioned total desired volume of the undeployed device.

Many of the early prior art devices mentioned above, use a metallic cylinder for containing the compressed gas, since the compressed gas used, usually $CO_2$, is under a pressure of about 80 atm. at ambient temperatures, such that the volume and weight of the device is significantly more than the desired target figures for such a device. Even if a nonmetallic cylinder is used, the wall thickness would have to be so thick to provide sturdiness, that this would result in a weight or bulkiness unsuitable for the optimal device specification. Furthermore, the actuating mechanism of such prior art devices is, due to the high pressures involved, more complex, leading to potential unreliability and expense in manufacture. Furthermore, the high pressures mandated may present a blast hazard in case of failure of the gas cylinder or its valving.

Thus, many of the products described in the above mentioned prior art documents are far from fulfilling these conditions, especially with regard to interference with swimming action. There therefore exists a need for a lightweight, reliable and easy-to-use emergency floatation device, which overcomes at least some of the disadvantages of prior art systems and methods.

The disclosures of each of the publications mentioned in this section and in other sections of the specification, are hereby incorporated by reference, each in its entirety.

SUMMARY

The above cited prior art patent documents generally describe the compressed gas as being air or carbon dioxide, these being readily compressible gases. In WO83/04234, Freon® is also mentioned as a useful inflation gas. However, there is then mentioned a disadvantage of the use of gases like Freon®, in that in expanding from its compressed liquid state to a gaseous state at atmospheric pressure, to fill the inflation chamber, because of the heat extracted from the surroundings while the expanding gas undergoes its phase change from liquid phase to gas phase, the gas cools down to such an extent that it can cause the gas release valve to freeze up in less than a fully open position, thereby delaying or even stopping the balloon inflation process. WO83/04234 therefore describes the use of a gas which has a boiling point at its stored pressure, well below the freezing point of water, so that the valve on the compressed gas bottle does not ice up when the compressed gas expands through it, even when the water in which it is being used is at only 1° C. The suggested gas mixture used in that publication is a mixture of 89% dichlorodifluoromethane (Freon R12) with 11% Propane, a mixture which was found to provide good flotation and which is gaseous at the lowest expected water temperatures, such that it does not undergo a phase change from gaseous state to liquid state in the region of the freezing point of water, and therefore avoids the freezing up of the release valve.

However, such a gas, in common with most gas fills used for such devices, while overcoming the freezing problems mentioned in WO83/04234, does not solve another problem which is apparent in all of the above mentioned prior art devices, and the gas mixture of WO83/04234, actually exacerbates that problem. Such gases have characteristics such that, when compressed to the level required to maintain the liquid phase at normal environmental temperatures, such as 15° C., the liquid phase would turn to the gaseous phase if allowed to heat up to a temperature of around 50° C., or even more. This is a temperature which could easily be reached if the device were left in the sun, or in a closed car in the sun, both such situations being likely in association with a beach or swimming pool environment. The high level of expansion when going from liquid to gaseous phase would result in a very large increase in pressure of the stored compressed gas. Therefore, the storage cylinder has to be constructed to have sufficient strength to withstand these high pressures, and would thus be of significantly greater weight and size than the target weight and size of the device. Solution of this problem is therefore essential in order to eliminate the need for such a sturdy and hence voluminous or weighty compressed gas container, and to maintain the safety of the devices during storage.

In the novel inflatable swimming devices described in the present disclosure, this problem is avoided by using a specifically selected gaseous material for the inflation fill, the gaseous material having thermodynamic characteristics such that even at the designated high environmental temperature, whether it is 50° C., or even slightly more, such as 70° C. as required by some military and other regulatory bodies, the pressure in the gas container will be no more than several bars. In contrast to prior art compressed gas cylinders, which may have to withstand pressures of many tens of atmospheres, thereby mandating a sturdy and weighty compressed gas container, the above mentioned design parameter enables the compressed gas container to be of lightweight construction that will not render it unduly heavy or mechanically complex. By use of the gases having the characteristics to be proposed in this disclosure, a lightweight compressed gas container may be used, even for exposure to high temperatures.

This solution is achieved by the use of a gas, which retains its liquid phase even at the high temperature end of the range over which the device is intended to be used or stored. For a predetermined working pressure of the compressed gas container, if, at the bottom end of the temperature range, the selected gaseous material at that same pressure is in its liquid phase, and is still in its liquid phase at the upper end of the temperature range, whether that is 50° C. or 70° C., the liquid expansion is relatively small requiring generally no more than approximately 6% additional volume over a range of from 25 to 50° C., and up to 10% additional volume over the wider range of from 0 to 70° C. For an initial storage volume of 20 ml, this represents only an additional 2 ml or so, which can be accommodated by not filling the gas container to its full volume. Alternatively, even for a fully charged container, such a limited volume increase can readily be accommodated by the slight flexibility of the walls of a polymer compressed gas container, and does not mandate any significant increase in the container wall thickness.

In contrast, in previously known flotation devices, the gaseous materials used, which have thermodynamic properties such that they are in a liquefied state at the low temperature end of the range for the internal pressure used, would undergo a phase change into the gaseous state before the temperature reaches the upper limit of the desired environmental range. Such a phase change to the gaseous state would be accompanied either when the volume of the liquid is allowed to vastly increase, by as much as two orders of magnitude or even more at constant pressure, such as indeed occurs when the device is actuated, or, since the compressed gas container must be rigid, and cannot expand, the internal pressure would have to increase by the same two orders of magnitude or so, in order to accommodate the now vastly increased effective volume of gas over that of the liquid before the phase change.

The gas fill of the present devices is characterized differently, in that it remains in its liquid phase over the whole range of temperatures to which it is to be exposed before inflation. The devices of the present disclosure use such a gaseous material, which remains in its liquid phase at a selected low compression level, right up to the maximum temperature to which the device is expected to be exposed, while showing only a slight increase in the internal pressure of the device as it heats up over its allowed temperature range. A number of refrigerant gases possess such a characteristic, namely of remaining in the liquid phase under a pressure of 10 bar or slightly more, a level that is manageable for a lightweight pressurized container, right up to an ambient temperature of around 50° C. or 70° C. At least three candidate gases have been located, and more may be found as the technology of refrigerant gases evolves. These gases were developed for use in refrigeration and air conditioning systems, and are characterized in that they have a molecular structure providing them with a short atmospheric lifetime, which means that they have very low global warming potential (GWP) index. However, regardless of which specific gases are found which fulfil these requirements, the important criterion is that they remain in the liquid state under the selected low pressure applied, right up to the maximum temperature which the device is expected to be exposed to during regular storage or use. Therefore, the compressed gas container does not have to suddenly withstand an increase in volume of almost two orders of magnitude, as the liquid phase changes to a gas phase. Besides the thermodynamic implications of the gas properties, for use in a compression refrigeration cycle, nowhere have the volumetric properties arising from the gas phase chart properties, been reported or used in such a device.

The practical result of this novel gas fill is that the compressed gas cylinder, can be constructed of a light material such as a polymer, and of substantially thinner material than the compressed gas containers of prior art devices, which have to withstand many tens of atmospheres of internal pressure. The gas fill container could therefore more aptly be called a gas capsule rather than a gas cylinder. One important advantage of such a construction is that the gas capsule itself, with its comparatively low internal pressure of only a few bar, can be sufficiently small and lightweight that it can be incorporated into a wrist or arm band. For such a small device, the inflation bag, being of thin material and flexible, can be folded into any design-mandated shape, such that it would not present any significant impediment to the swimmer when undeployed. Alternative attachment and wearing configurations, include those in which the inflation bag is located around the waist, like a belt, or at chest height, and is attached to the user's body by an attachment belt running under the user's armpits. Another possible configuration could be for the device to be worn as a collar around the neck, thereby ensuring that the head is held above water on deployment.

Furthermore, the comparatively low pressures used mean that the gas release mechanism can be of simple, and hence light construction, thereby decreasing cost and increasing reliability. Any form of closure between the compressed gas container and the inflatable bag can be used, provided that it is gastight over the storage period planned for the device, and can be readily removed when the device is to be used. The internal pressure of the compressed gas container is so low—less than 10 bar for some configurations—that even a "valve" as simple as a rubber stopper can be used for this purpose.

A further advantage of the comparatively low pressure in the gas capsule is that the device is more flight compliant than prior art devices with high pressure cylinders.

The gaseous material used has to comply with environmental requirements, and with health and safety requirements, especially with regard to toxicity and flammability. The gas must also be compatible with the construction material of both the compressed gas container and the flotation bag.

Furthermore, the use of plastic compressed gas container avoids any likely possibility of corrosion effects occurring in the moist environment which the device is likely to encounter, while prior art metallic cylinders would be expected to need to contend with such an environment.

Additionally, the use of a "plastic gas capsule" may enable simpler manufacturing processes to be used in constructing the device, possibly by using unitary extrusion processes or Injection molding to generate all parts of the device. Such a construction would not only bring the cost of the device to acceptably low levels but may also alleviate the possibility of the gas release mechanisms becoming frozen, as was encountered with the prior art designs.

Finally, as with all such flotation devices, automatic inflation can be applied, using any of the methods known in the art. However, the use of physiological signs of distress, such as, for instance, a suddenly increased pulse rate, is another novel feature of the presently described device. Additionally, a sensor can be used to detect when the device is under water for an unexpectedly long time, rather than the expected situation of being in the air at intervals. Such a sensor could be electrical or based on ultrasound attenuation.

It is to be understood that the term "gaseous material" is used in the present disclosure, and is thuswise also claimed, to refer to a material which is gaseous at normal ambient temperatures and at atmospheric pressure, as is the popular understanding of the term "gas". Such a "gaseous material" may also be in its liquid phase if at the appropriate temperature and pressure, (or even in its solid phase if at a sufficiently low temperature), but in all cases, it is still described and claimed in this disclosure, as "a gaseous material", which could be either in its gaseous phase or its liquid phase.

There is therefore provided, in accordance with an exemplary implementation of the presently disclosed devices, a flotation device comprising:

(i) a container adapted to hold a charge of a pressurized gaseous material, and adapted to withstand a pressure of 10 bar, (ii) a flexible flotation chamber communicating with the compressed gas container through a passage, the passage remaining normally closed until its opening is actuated, and (iii) a mechanism adapted to actuate opening of the passage to allow the charge to expand into the flotation chamber, thereby inflating the flotation chamber, wherein the gaseous material has thermodynamic properties such that when compressed into the container at a pressure of not more than 10 bar, it remains in a liquid phase over a range of temperatures of up to 50° C.

In such a flotation device the container may alternatively be adapted to withstand a pressure of 14 bar, and the gaseous material may have thermodynamic properties such that when compressed into the container at a pressure of not more than 14 bar, the gaseous material remains in a liquid phase over a range of temperatures of up to 70° C. Yet more alternatively, the container may be adapted to withstand a pressure of 21 bar, and the gaseous material may have thermodynamic properties such that when compressed into the container at a pressure of not more than 21 bar, the gaseous material remains in a liquid phase over a range of temperatures of up to 70° C.

Furthermore, in any of the above described flotation devices, the mechanism is adapted to be manually operated by a user, or alternatively it is adapted to be operated automatically, independently of the user.

Additionally, the passageway may be a valve, or it may be closed by a stopper, which is adapted to be released when the device is activated.

According to even more implementations of the flotation devices of the present disclosure, the container may occupy a volume of less than 80 milliliters and the charge of gaseous material should expand to at least 5 liters when released into the flexible flotation chamber.

Additionally, in any of the above described flotation devices, the pressurized charge of gaseous material in its liquid phase may expand by less than 12% over a range of temperatures of from 15° C. to 50° C., or alternatively, it may the gaseous material expands by less than 15% over a range of temperatures of from 15° C. to 70° C.

Any of the above described devices may further comprise a sensor indicative of immersion in water for more than a predetermined time, and providing a signal to activate the inflation device. Alternatively or additionally, the sensor may be adapted to detect any one of vibration, depth, pressure or light.

In any of the above described flotation devices, the gaseous material may comprise a Tetrafluoropropene-based hydrofluoroolefin. If so, it may comprise R1234ze(E) or R1234yf or R1224yd(Z). Alternatively, it may comprise R134A.

The devices may have a strap configured to enable them to be worn on any of the wrist, arm, waist, chest or neck of a user.

According to yet further exemplary implementations described in this disclosure, there is provided a flotation device comprising:

(i) a container adapted to hold a charge of a gaseous material under a predetermined pressure, (ii) a flexible flotation chamber communicating with the compressed gaseous material container through a passage, the passage remaining normally closed until its opening is actuated, and (iii) a mechanism adapted to actuate opening of the passage to allow the charge to expand into the flotation chamber, thereby inflating the flotation chamber, wherein the gaseous material has thermodynamic properties such that its vapor pressure at a temperature of up to 70° C. is less than 21 bar.

In such a flotation device, the gaseous material may have thermodynamic properties such that its vapor pressure at a temperature of up to 70° C. is less than 14 bar, or it may have thermodynamic properties such that its vapor pressure at a temperature of up to 50° C. is less than 10 bar.

According to even further embodiments of the flotation devices described in this application, there is provided another flotation device comprising:

(i) a container having walls, constructed of a polymer material of less than 3 mm in thickness, and adapted to hold a charge of a gaseous material under a predetermined pressure of no more than 21 bar at an ambient temperature of up to 70° C., (ii) a flexible flotation chamber communicating with the container through a passage, the passage remaining normally closed until its opening is actuated, and (iii) a mechanism adapted to actuate opening of the passage to allow the charge to expand into the flotation chamber, thereby inflating the flotation chamber, wherein the gaseous material has thermodynamic properties such that when compressed into the container under a pressure of no more than 21 bar, it remains in a liquid state even at a temperature of up to 70° C.

In such a flotation device, the gaseous material may have thermodynamic properties such that when compressed into the container under a pressure of no more than 14 bar, it remains in a liquid state even at a temperature of up to 70° C. Alternatively, it may have thermodynamic properties such that when compressed into the container under a pressure of no more than 10 bar, it remains in a liquid state even at a temperature of up to 50° C.

Finally, this flotation device, the container may have walls constructed of a polymer material of less than 2.5 mm in thickness, and the gaseous material may have thermodynamic properties such that when compressed into the container under a pressure of no more than 10 bar, it remains in a liquid state even at a temperature of up to 50° C.

BRIEF DESCRIPTION OF THE DRAWINGS

The present invention will be understood and appreciated more fully from the following detailed description, taken in conjunction with the drawings in which.

DETAILED DESCRIPTION

Figure 1:
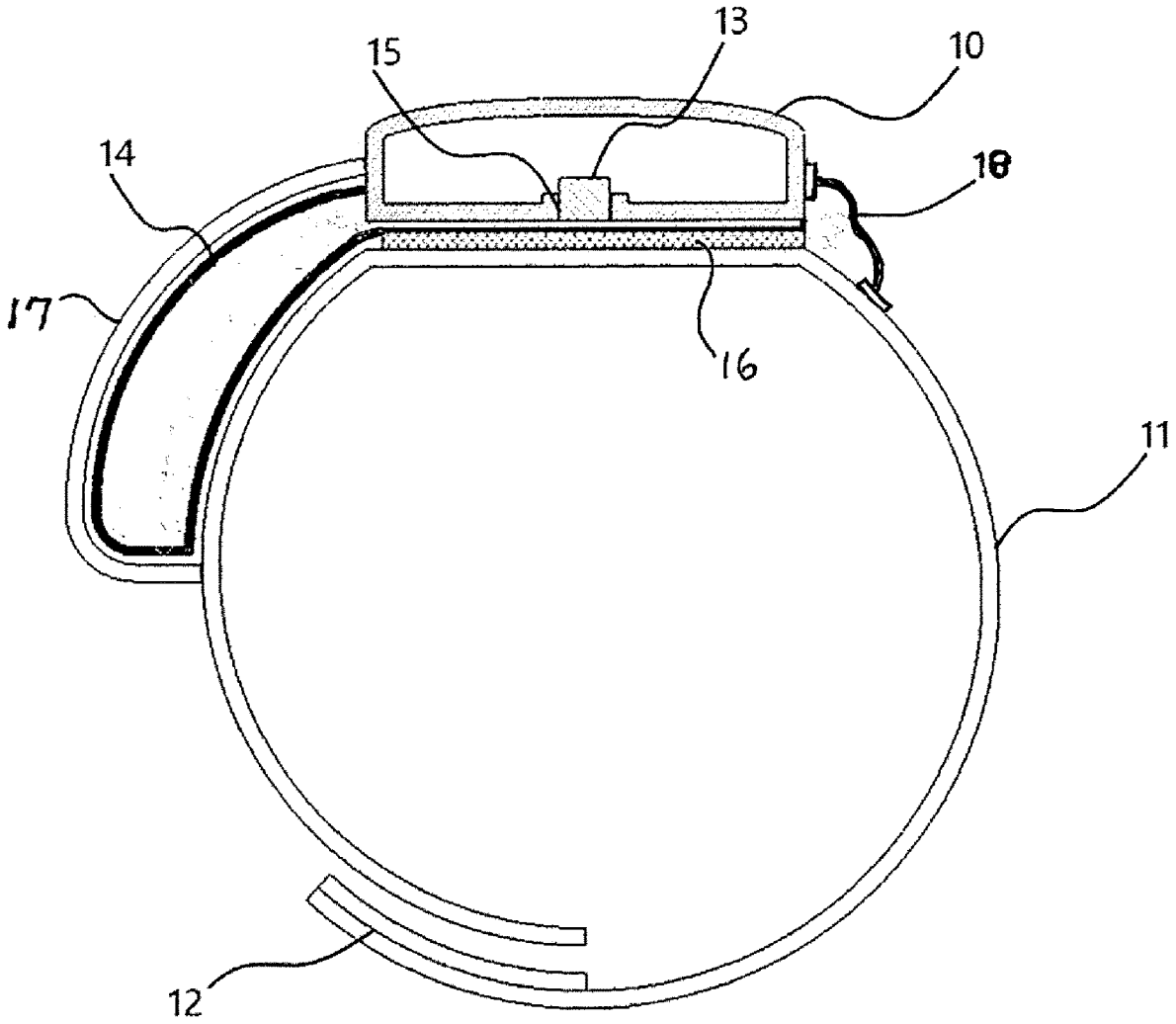
FIG. 1 shows a schematic cut-away drawing of an exemplary implementation of the emergency flotation devices described in the present disclosure.

Reference is first made to FIG. 1, which shows a schematic cut-away drawing of the cross section of an exemplary implementation of the emergency flotation devices described in the present disclosure. The example shown is for a device which is to be wrist or upper-arm mounted, though it is to be understood that similar construction of the operative mechanism may be used for the device to be mounted on any other part of the user's body, by use of the appropriate attaching straps. Examples of other such attachment modes could be for a waist belt application, or for a chest mounted application, with straps attached around the user's body under the arm pits, or for a neck-tie arrangement, with the device supporting the swimmer's head above water. Fixation on the upper arm is used to describe the presently disclosed example of the device. The pressurized gas container 10 is held by means of a flexible strap 11 on the limb to which it is attached, such as by the use of a Velcro® fastening section 12, or any other fixation means. The gas container 10 may be constructed of a thin polymeric material such as nylon, and because of the comparatively low pressure of the contained pressurized gas, and the small size of the container, the wall may be as thin as 2.5 mm, or even less depending on the size of the container, thus contributing to a lightweight device. Alternatively, the container may be made of thin metallic foil, or a foil-plastic composite material. Such a thin walled plastic container may therefore also be slightly flexible, such that, if the liquefied gas fills the entire volume, it can expand somewhat with increase in environmental temperature. However, to maintain optimal thermodynamic equilibrium conditions, it would be preferable that the liquefied gas should not completely fill the entire volume of the pressurized gas container, so that the increase in internal pressure of the gas container with increased environmental temperature is minimized.

The pressurized gas container 10 is connected by means of a passageway 15 to the inflatable flotation bag 14, which is protected during storage and when normally used for swimming by a cover 17, which detaches if the bag inflates. The flotation bag 14 is shown for simplicity as a single layer, but it is to be understood that it could have a folded configuration such that a large bag can fit snugly attached to the arm band 11. The passageway can be closed by any means which is gas-tight, but which can be readily removed when the device is activated. In the example shown in FIG. 1, the passageway 15 is closed by means of a simple rubber stopper 13, which is held in place by means of a back-plate 16, held against the bottom face of the gas container 10 by any suitable mechanism, such as a magnetic catch, or a mechanical clasp, or a simple adhesive layer. When the compressed gas container 10 is pulled away from the flexible strap 11 as the user activates the device, in one exemplary implementation, by pulling on an actuating ring attached to a cord, the connection to the back plate 16 is broken, and even the comparatively low pressure of the compressed liquefied gas in the gas container can now eject the stopper 13 into the inflation bag 14, allowing the gas to flow out through the passageway into the inflatable bag 14. The space generated between the gas container bottom surface and the back plate 16 is sealed at its outer edge, as shown at the right hand side of the gap, so that gas flowing out of the gas container cannot escape and is directed only into the inflation flotation chamber 14. The liquefied gas fill expands into the chamber 14, which is at atmospheric pressure, until it is full, typically filling a volume of 5 liters, and is thus capable of supporting an adult user. Larger models can be envisaged for the purpose of supporting more than one person, or a piece of equipment. Devices can also be produced having a smaller charge and volume for use by children. The inflated flotation bag 14, attached to the now empty gas container 10, should be connected to the strap 11, such as by a leash 18, such that the bag supports the limb on which the device is strapped. Although the activation mechanism shown in FIG. 1 is a particularly simple and low cost arrangement, it is not intended to be the only possible mechanism for use with the devices of the present disclosure, and any suitable, simply activated mechanism, may equally well be used.

Figures 2, 3:
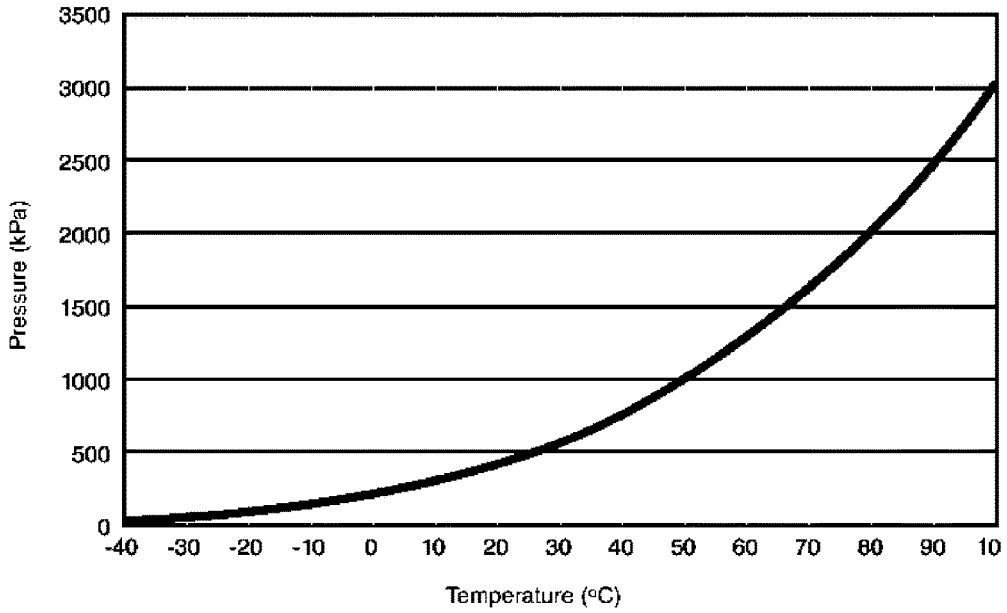
FIG. 2 is a table showing the vapor pressure as a function of temperature for one type of gas for use in the device of FIG. 1.
FIG. 3 is a graph showing the relationship between vapor pressure and temperature for the gas shown in the table of FIG. 2.

Reference is now made to FIG. 2, which is a table obtained from a specification document entitled "The Environmental Alternative to Traditional Refrigerants", published in 2015 by Honeywell Belgium N. V., showing the vapor pressure as a function of temperature for a new, environmentally favorable refrigerant of the Solstice® ze class. This gas is chemically trans-1,3,3,3,-Tetrafluoroprop-1-ene, and has been assigned the nomenclature R-1234ze(E) under the ASHRAF Standard 34 for refrigerants. As is observed in FIG. 2, the boiling point at atmospheric pressure, i.e. at 101.3 kPa, is approximately −19° C., and the vapor pressure at 20° C. is still only slightly more than 4 bar absolute, approaching 10 bar absolute at 50° C. and 16 bar at 70° C. Thus, for instance, the gas fill of R-1234ze(E) will remain in its liquid state at up to 50° C. if the pressure in the gas capsule is maintained at 10 bar, and to 70° C. if the gas capsule can sustain a pressure of 16 bar.

FIG. 3 is a graph showing the relationship between vapor pressure and temperature for the R-1234ze(E) gas shown in the table of FIG. 2.

Another refrigerant gas, (Z)-1-chloro-2,3,3,3-Tetrafluoroprop having similar properties, is also available from AGC Chemicals Inc., of Exton, PA, in the Amolea® family, and is designated R1224yd(Z). R1224yd(Z) has a boiling point of 14° C. at atmospheric pressure, and that the fill will remain in its liquid state at a temperature of 50° C. under a pressure of only 3.4 bars, making it even more useful for the device than R-1234ze(E), since the internal pressure required of the pressurized gas container is even less.

Yet another suitable refrigerant gas is R134A, which is chemically 1,1,1,2-Tetrafluoroethane. It is widely used for air conditioning systems, and is significantly cheaper than the previously mentioned gas this. R-134A has a boiling point at atmospheric pressure of −26° C., and its vapor pressure at 50° C. is 13.5 bar, and at 70° C., it is 21 bar. Hence, though requiring a higher pressure capsule, it may be more useful than the previously mentioned Tetrafluoroprop family of gases, for devices which must be rated for storage temperatures of up to 70° C.

The material of the liquefied gas container and of the inflatable flotation bag must be of a composition which is not degraded significantly by the liquid or gaseous fill.

In order to make activation of the device independent of the user's cognitive abilities, or even consciousness, both to which are factors for consideration in designing such a device, the device can be improved by incorporating an automatic activation mechanism. A depth sensor or pressure sensor (e.g., an ultrasonic sensor) may be connected to the inflation device, such that when the sensor reaches a predefined depth for an unreasonable period of time, it automatically activates the inflation device. This enables automatic activation of the device if the swimmer sinks into the water. Alternatively or additionally, the user's pulse or motion pattern may be discerned, and used to assume distress, and to activate the inflation of the device automatically. Such additions would, however, entail a more complex and costly device.

It is appreciated by persons skilled in the art that the present invention is not limited by what has been particularly shown and described hereinabove. Rather the scope of the present invention includes both combinations and subcombinations of various features described hereinabove as well as variations and modifications thereto which would occur to a person of skill in the art upon reading the above description and which are not in the prior art.

We claim:

1. A flotation device comprising:

a container adapted to hold a charge of a pressurized gaseous material having thermodynamic properties such that when compressed into the container at a pressure of not more than 10 bar, it remains in a liquid phase over a range of temperatures of up to 50° C.; and a flexible flotation chamber communicating with the compressed gas container through a passage, the passage remaining normally closed until its opening is actuated, thereby allowing the charge to expand into the flotation chamber, and to inflate the flotation chamber, wherein the passage is closed by a stopper held in the passage by a backplate, the backplate being adapted to be separated from contact with the stopper when the device is activated, such that the pressure of the gas in the pressurized gas container is sufficient to eject the stopper.

2. A flotation device according to claim 1, wherein the gaseous material has thermodynamic properties such that when compressed into the container at a pressure of not more than 14 bar, it remains in a liquid phase over a range of temperatures of up to 70° C.

3. A flotation device according to claim 1, wherein the device is adapted to be manually activated by a user.

4. A flotation device according to claim 1, wherein the container occupies a volume of less than 80 milliliters and the charge of gaseous material expands to at least 5 liters when released into the flexible flotation chamber.

5. A flotation device according to claim 1, further comprising a sensor indicative of immersion in water for more than a predetermined time, and providing a signal to activate the inflation device.

6. A flotation device according to claim 1, further comprising a sensor adapted to detect any one of vibration, depth, pressure or light.

7. A flotation device according to claim 1, wherein the gaseous material comprises a Tetrafluoropropene-based hydrofluoroolefin.

8. A flotation device according to claim 1, wherein the gaseous material comprises at least one of R1234ze(E) or R1234yf or R1224yd(Z).

9. A flotation device according to claim 1, wherein the device has a strap configured to enable the device to be worn on any of the wrist, arm, waist, chest or neck of a user.

10. A flotation device according to claim 1, wherein the container has walls constructed of a polymer material of less than 2.5 mm in thickness.

11. A flotation device according to claim 1, wherein the stopper is held in the passage in such a manner that when the device is actuated, a pressure of no more than 10 bar of the gaseous material in the container is sufficient to eject the stopper to enable the pressurized gaseous material to inflate the flexible flotation chamber.

12. A flotation device according to claim 1, wherein the stopper is held in the passage in such a manner that when the device is actuated, a pressure of no more than 14 bar of the gaseous material in the container is sufficient to eject the stopper to enable the pressurized gaseous material to inflate the flexible flotation chamber.

* * * * *